US008893752B2

(12) United States Patent
Clüsserath

(10) Patent No.: US 8,893,752 B2
(45) Date of Patent: Nov. 25, 2014

(54) METHOD FOR FILLING BOTTLES OR SIMILAR CONTAINERS AND FILLING MACHINE

(75) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 706 days.

(21) Appl. No.: 13/143,597

(22) PCT Filed: Mar. 17, 2010

(86) PCT No.: PCT/EP2010/001678
§ 371 (c)(1),
(2), (4) Date: Jul. 7, 2011

(87) PCT Pub. No.: WO2010/112141
PCT Pub. Date: Oct. 7, 2010

(65) Prior Publication Data

US 2011/0272060 A1 Nov. 10, 2011

(30) Foreign Application Priority Data

Mar. 30, 2009 (DE) ..... 10 2009 014 857

(51) Int. Cl.

| | |
|---|---|
| ***B65B 3/04*** | (2006.01) |
| ***B67C 3/22*** | (2006.01) |
| ***B65B 3/22*** | (2006.01) |
| *B67C 3/26* | (2006.01) |

(52) U.S. Cl.
CPC ..... *B65B 3/22* (2013.01); *B67C 2003/2671* (2013.01); *B67C 3/22* (2013.01); *B67C 3/222* (2013.01)
USPC ..... 141/11; 141/69; 141/70; 137/12.5; 137/170.3; 516/115

(58) Field of Classification Search
CPC ..... B65B 3/22; B01D 19/02
USPC ..... 516/115, 116; 141/11, 69, 70; 137/12.5, 137/170.1, 170.3; 426/232, 329, 330.3, 426/395, 397, 477, 238; 95/30, 242; 96/175, 176, 202; 53/111 R, 428, 432
See application file for complete search history.

(56) References Cited

U.S. PATENT DOCUMENTS

| | | | | |
|---|---|---|---|---|
| 3,088,831 | A * | 5/1963 | Fauth et al. | 426/238 |
| 4,295,502 | A | 10/1981 | Matzner | |
| 5,038,548 | A | 8/1991 | Sieg | |
| 6,190,713 | B1 * | 2/2001 | Babel | 426/232 |
| 6,599,948 | B1 * | 7/2003 | Hammond | 516/115 |
| 7,104,033 | B2 * | 9/2006 | Krulitsch | 53/467 |
| 8,026,288 | B2 * | 9/2011 | Takenouchi et al. | 516/115 |
| 8,218,730 | B2 * | 7/2012 | Okamura | 378/133 |
| 8,329,764 | B2 * | 12/2012 | Takenouchi et al. | 516/115 |

FOREIGN PATENT DOCUMENTS

| | | |
|---|---|---|
| DE | 2926955 | 10/1981 |
| DE | 3147667 | 6/1983 |
| DE | 3226172 | 1/1984 |
| EP | 1977807 | 10/2008 |
| JP | 63104620 | 5/1988 |
| JP | 63252509 | 10/1988 |

* cited by examiner

*Primary Examiner* — Timothy L Maust
*Assistant Examiner* — Timothy P Kelly
(74) *Attorney, Agent, or Firm* — Occhiuti & Rohlicek LLP

(57) ABSTRACT

The invention relates to a method for filling bottles or similar containers with a liquid product at a filling position, using a filling element for the controlled delivery of the product into the respective container, the foam formation of the product inside the respective container already being reduced and/or suppressed during the formation stage by a treatment or by influencing the product.

18 Claims, 2 Drawing Sheets

METHOD FOR FILLING BOTTLES OR SIMILAR CONTAINERS AND FILLING MACHINE

RELATED APPLICATIONS

This application is the national stage under 35 USC 371 of PCTEP2010/001678, filed on Mar. 17, 2010, which claims the benefit of the Mar. 30, 2009 priority date of German application 10 2009 014 857.4, the contents of which are herein incorporated by reference.

FIELD OF INVENTION

The invention relates to container processing, and in particular, to filling bottles.

BACKGROUND

Methods for filling bottles or other containers are known in various embodiments. What is often a disadvantage is that during or after the filling, the product foams. Sometimes the foam overflows the container. This leads to product loss and contamination of both the container and the filling machine.

This undesired foaming has different causes. It can happen, for example, as a result of turbuence. In the case of pressure filling, foaming can occur upon relieving the pressure in the container to a lower pressure, or upon pulling the container off the filling element.

Foaming can also result from the type of product. In a $CO_2$ containing product that is introduced into the containers under pressure, undesired foam formation is caused after completion of the filling and during the relief of the filled containers to atmospheric pressure by the $CO_2$ gas bound in the product or also by unbound $CO_2$ gas exiting during relief, particularly when an exceedingly long killing and relief phase is not desired after completion of the filling in order to increase the performance of a filling machine (number of filled containers per unit of time).

Even when containers are filled under normal pressure or by a free jet filling method where the containers and their container openings are spaced apart from the filling element and the product thus flows into the containers in a free jet, for example when bottling still beverages or juice beverages, undesired foaming may often occur due to a property of the product, for example due to pulp or fruit fibers and/or to gas bubbles adhering to them, the gas bubbles having been introduced into the product.

SUMMARY

An object of the invention is to present a method by which the disadvantages of undesired foam formation are effectively avoided.

In one aspect, the invention features a method for filling containers with a liquid product at a filling position. Such a method includes using a filling element for the controlled delivery of the product into the container, and at least one of reducing and/or suppressing foam formation in the product inside the container during a foam-formation stage by a treatment or by influencing the product and/or the foam. Reducing and/or suppressing foam formation comprises directing ultrasonic energy through a return gas tube that is open at both ends thereof into a headspace above a surface of liquid product in the container.

In some practices, reducing and/or suppressing foam formation is carried out in a container located at the filling position.

In other practices, reducing and/or suppressing foam formation is carried out while filling the container, after filling the container, or during a relief phase subsequent to filling the container.

Yet other practices include, after reducing and/or suppressing foam formation, causing controlled foaming of the product, for example, by introducing energy into the product.

Other practices include those in which introducing energy comprises directing ultrasonic energy to the product level in the container and those in which introducing energy comprises introducing a gaseous pressure medium.

In another aspect, the invention features an apparatus for filling containers with a liquid product. Such an apparatus includes a filling machine having a filling position, a filling element at the filling position for the controlled delivery of the product into a container, a return gas pipe having a first end and a second end, the second end opening into a headspace of the container, and an influence-generating element, at the filling position for generating an influence on the liquid product inside the container. This influence causes a reduction and/or suppression of foam formation in the liquid product inside the container. The influence-generating element comprises an ultrasonic generator disposed to direct ultrasonic energy into the first end of the gas pipe for propagation into the headspace.

In some embodiments, influence-generating element is configured to be within an area of the product level inside the container, whereas in others, the influence-generating element is configured to be inside the container.

In other embodiments, the filling machine includes a plurality of filling positions, each having a filling element. Each filling element comprises a gas pipe having a first end and a second end, and an energy source for generating an energy input. The energy source, which is provided independently of each filling position, includes an ultrasonic generator disposed to direct ultrasonic energy into the first end of a gas pipe for propagation into a headspace into which the second end opens.

Some embodiments also include means for controlling the element such that energy from the an influence-generating element is provided while filling the container.

In other embodiments, the filling machine includes a plurality of filling positions, each having a filling element. In these embodiments, the apparatus comprises an energy source that provides energy jointly for all filling positions or an energy source that provides energy jointly for a group of the filling positions within the plurality of filling positions.

Other embodiments include means for controlling the element such that the treatment is carried out after filling the container, or means for controlling the element such that the treatment is carried out until a filled container is lifted from the filling position.

A special feature of the invention is the fact that the reduction and/or suppression of the foam or the foam formation is carried out already during the formation of the foam, that is, already during the foam formation, by a corresponding treatment or influence. Another special feature of the invention is that the treatment or influence is already performed at the point in time and the place when foam could be formed and foam formation could occur, respectively.

Thus, a treatment or influence is performed in particular during the running-in of the liquid product into a container or during the filling (filling phase), and/or subsequently to the filling, for example, during the period of time when the respective container is still at the filling position after completion of the filling or during a part of this period of time, for example, during a killing and/or relief phase subsequent to the filling.

The treatment or influence reducing or suppressing the foam formation is performed at the respective filling position, that is, as long as the container in question is still inside the filling machine. The treatment or influence is preferably performed within the range of the product level in the respective container, that is, where undesired foam formation occurs or could occur. The treatment or influence is preferably performed by the introduction of energy, for example by ultrasonic or infrasonic energy, by the introduction of energy by means of a gaseous or vaporous pressure medium, for example by pressurizing a foam layer formed or about to be formed at the product level with the pressure of the pressure medium and/or light energy, for example, with at least one laser beam.

The source for generating the energy input is provided e.g. separately for each filling position of the filling machine used for filling or jointly for all filling positions or groups of a plurality of filling positions.

In a particular embodiment of the invention the foam formation is reduced and/or suppressed in the above-described manner, that is, during the filling and/or after the filling by a corresponding treatment or influence. Subsequently thereto, prior to closing the respective container, the product is foamed in a controlled manner in order to hereby evacuate air and thus also air/oxygen with the foamed product from that part of the interior of the container above the product level that is not taken up by the product, that is, the head space of the respective container, and thereby improve the storage life, in particular of an oxygen-sensitive product, for example, the storage life of beer. This controlled foaming may be performed in a controlled or reproducible manner such that foaming over and thus an exit of the product from the respective container does not occur.

Systems for controlled foaming of a product are known to the person skilled in the art so that no further explanations in this regard will be needed at this point.

Developments, advantages and possible applications of the invention will also result from the following description of embodiments and from the Figures. All described and/or illustrated features separately or in any combination are principally the subject-matter of the invention, independently of their summary in the claims or their reference. The content of the claims is also made an integral part of the description.

BRIEF DESCRIPTION OF THE DRAWINGS

The invention is explained in more detail in the following detailed description and its accompanying figures, in which.

DETAILED DESCRIPTION

Figure 1:
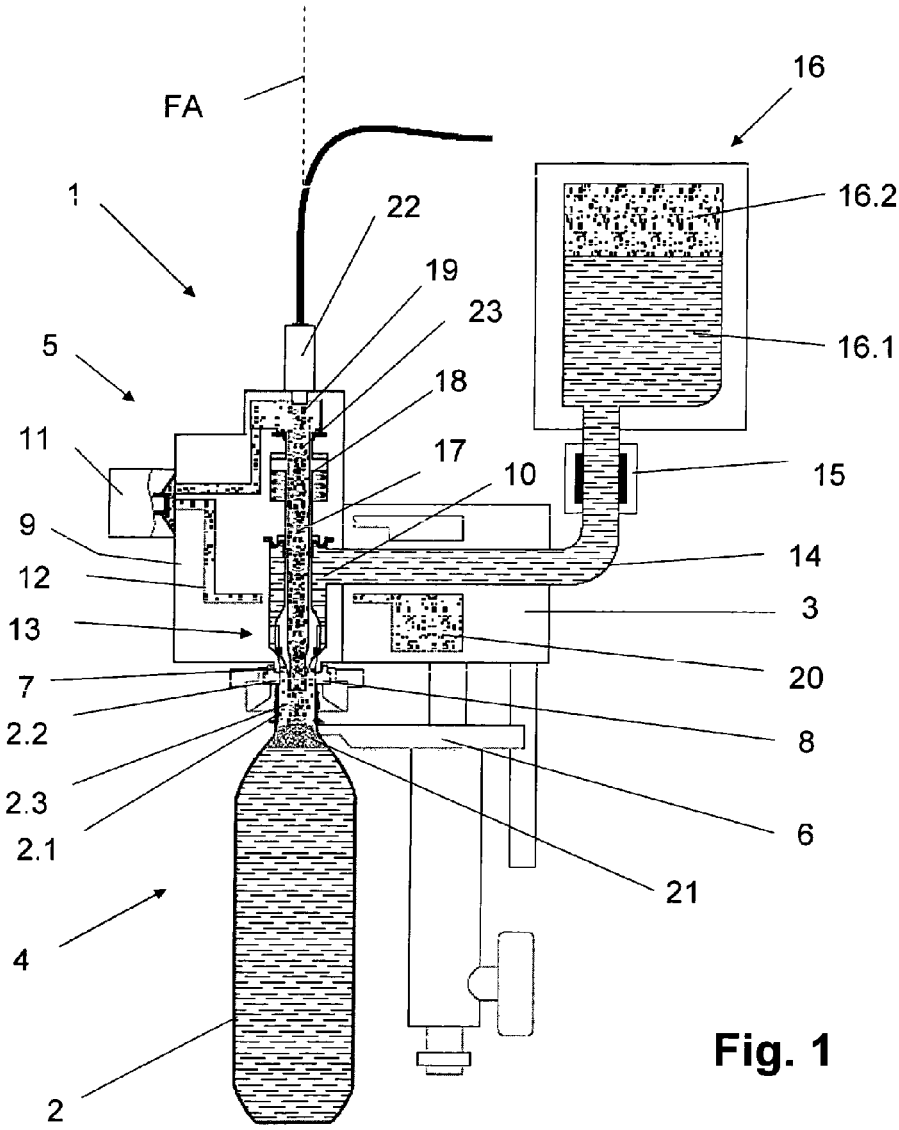
FIGS. 1 and 2 show a filling element of a filling system of a filling machine according to the invention in different operating states in a simplified representation and in a sectional view.

The filling system 1 in the figures pressure-fills bottles 2 with a liquid product. The filling system 1 is a component of a filling machine of a rotary construction comprising a rotor 3 that can be driven so that it rotates about a vertical machine axis. Filling positions 4 at the periphery of the rotor 3 each consist of a filling element 5 and a container carrier 6 that lifts a bottle 2 during filling thus placing the bottle's opening 2.2 in a sealing position against the filling element 5 while suspended at a carrier or bottle flange 2.1 or against a seal 8 of a central taper enclosing a delivery opening 7.

A liquid channel 10 and gas paths 12 controlled by at least one control valve 11 are formed in a filling element housing 9. The liquid channel 10 forms a delivery opening 7 in which a liquid valve 13 controlling the delivery of the liquid product into the bottle 2. The delivery opening 7 is ultimately connected to a kettle 16 via a product pipe 14 having a flow meter 15. The kettle 16 is commonly provided at the rotor 3 for all filling elements 5 of the filling machine.

During the filling operation, the kettle 16 is filled in part with the liquid product. This forms a liquid space 16.1 taken up by the product and a gas space 16.2 above the liquid space 16.1. The gas space 16.2 is filled under pressure with an inert gas, for example $CO_2$ gas.

In the housing 9, a return gas pipe 17 is provided coaxially with a filling element axis FA. The return gas pipe 17 simultaneously forms a valve rod of a liquid valve actuated by an actuating device 18. At its upper end, the return gas pipe 17 feeds into a chamber 19 that is a component of the gas paths 12 inside the filling element housing 9.

The filling of the bottles 2 by means of the filling system is performed in a known manner. After preferably having been rinsed and/or evacuated with the inert gas ($CO_2$), a bottle 2, which is located in a sealing position at the filling element 5, is pre-stressed under pressure. When the liquid valve 13 is opened, liquid product is introduced in a volume-controlled manner into the bottle 2 by using a signal from the flow meter 15. This is followed by an optional killing phase. After the optional killing phase, the bottle 2 is pressure-relieved. This occurs by first pre-relieving to a reduced pre-relief pressure via the return gas channel 17, via the chamber 19, and via the opened control or relief valve 11 in an annular channel 20 that is commonly provided at the rotor 3 for all filling elements 5. Subsequently thereto, the pressure is further relieved to atmospheric pressure and bottle 2 is pulled-off or lowered from the filling element 5.

Figure 2:
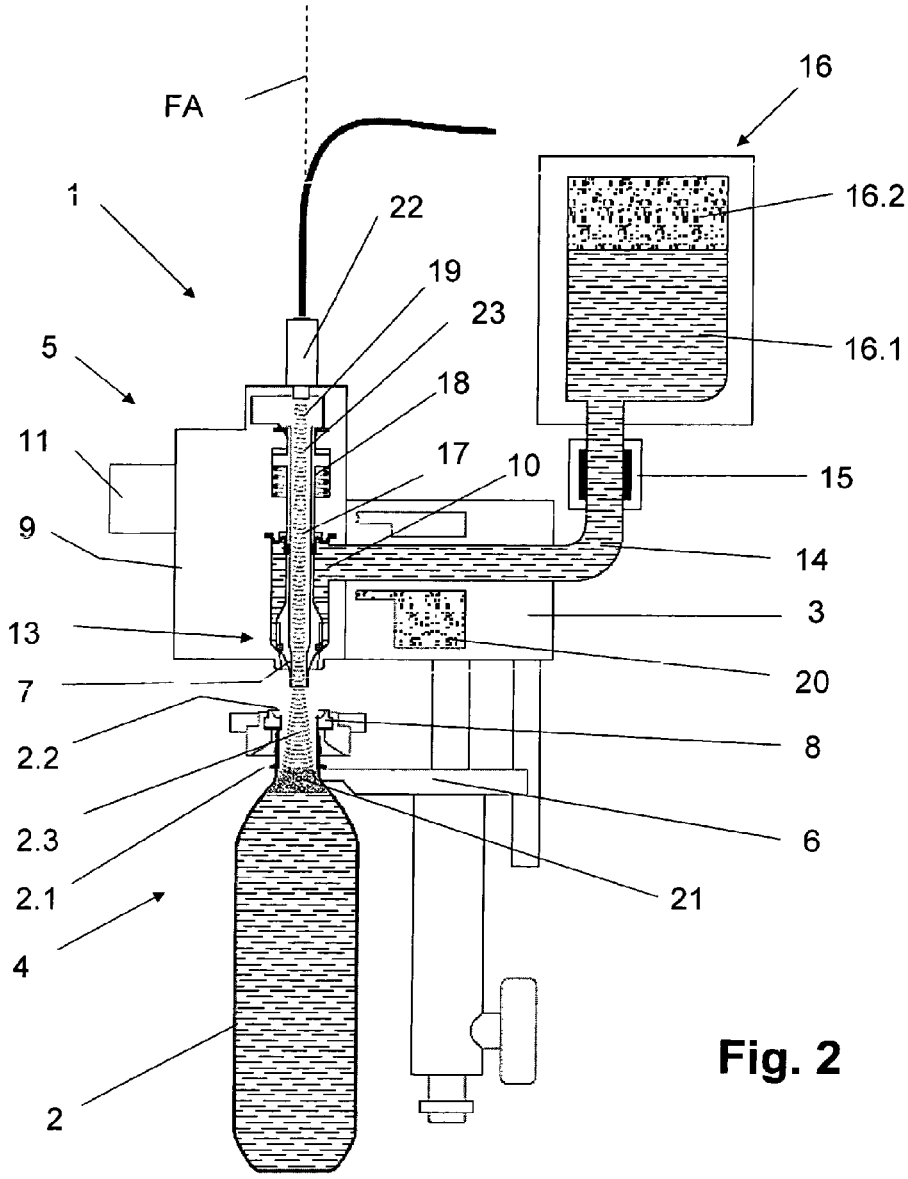

FIG. 1 shows the filling element 5 in the pre-relief state. FIG. 2 shows the filling element 5 with the bottle 2 lowered.

A certain "degassing", that is, an exit of micro bubbles, already occurs during the pre-relief (FIG. 1) at the product level inside the bottle 2 the consequence of which is undesired foam formation 21 in the head space 2.3 of the bottle 2. This foam formation is caused, for example, by micro bubbles of the inert gas used for pre-stressing which were introduced and/or driven into the product during filling due to an incomplete laminar product flow, or $CO_2$ gas that is in excess in a $CO_2$ containing product, which is released during filling and/or during the partial or pre-relief.

In order to avoid this foam formation 21, which would intensify with the increasing relief of the bottle 2 to atmospheric pressure and during pull-off of the bottle 2 from the filling element 5 and possibly lead to foaming over, which is, an exit of foamed product from the respective bottle 2 and in combination therewith to product losses and/or a contamination of the respective bottle 2 and/or the filling machine, an introduction of energy, which avoids or at least reduces foam formation, is carried out into the head space 2.3 after completion of the filling, that is, after the liquid valve 13 has been closed, and at least during the pressure relief in the embodiment shown in FIG. 1 in the form of ultrasonic energy. To this end, an electro-acoustic converter 22 or an ultrasonic wave generator 22 generating electrical ultrasonic energy is provided at the top surface of each filling element housing 9, which is controlled by the central controller of the filling machine and generates an ultrasonic wave 23 directed to the product level that reduces, dissolves or inhibits the foam formation 21 from the beginning. The ultrasonic wave generator 22 is disposed in such a way that the ultrasonic wave 23 generated by it is directed into the head space 2.3 through the chamber 19 and the return gas pipe 17 open at both ends and thus to the product level inside the respective bottle 2. For example, the ultrasonic wave generator 22 is activated at the end of filling, that is, after the liquid valve 13 has been closed, and during the subsequent pressure relief of the respective bottle 2, that is, during pre-relief (FIG. 1), during the final relief to atmospheric pressure and during the lowering of the filled bottle 2 from the filling element 5. The ultrasonic wave generator 22 is still activated when the bottle has been lowered from the filling element 5 (FIG. 2).

Therefore, in the embodiment shown in FIGS. 1 and 2, the introduction of energy starts by activating the ultrasonic generator 22 at least or at the latest with the closing of the liquid valve 13 and extends over the entire killing and relief phase, for example, until the bottle 2 lowered from the filling element 5 is removed at a bottle outlet of the filling position 4 in question.

Of course, there is the possibility that for outputting the ultrasonic wave 23 the ultrasonic generator 22 is activated additionally during filling, that is, before the liquid valve 13 is closed, in order to avoid foam formation already at that point in time.

The energy input that suppresses foam formation or at least avoids foaming over may also be performed in another way, for example by an infrasonic transmitter or generator, by a gaseous and/or vaporous pressure medium, for example, by a pulsed discharge of a gaseous or vaporous medium, by a light source, for example, a laser beam, etc. Combinations of different energy inputs are possible, too. However, all embodiments have in common that the introduction of energy is made as long as the respective bottle 2 or another container is at the respective filling position 4 or still inside the filling system, that is, during the filling process and/or after the liquid valve 13 is closed and during the killing and/or relief phase.

In particular in case of filling under normal pressure or in case of free jet filling, for example, of still beverages, e.g. juice beverages, the energy is already being input during filling. As a result, formation is already being suppressed in the formation phase.

In comparison to known filling systems or filling methods, the filling system 1 according to the invention and the method for filling bottles and other containers enable a considerable increase in the performance of a filling machine (number of filled bottles 2 or containers per unit of time), in particular also in case of a $CO_2$-containing product or another product with a tendency to foam because the period of time of the killing and relief phase, which makes up a comprehensive portion of the total filling time in known filling systems or methods, can be considerably reduced by the invention.

In particular, in an oxygen-sensitive product, it is preferred to perform additional controlled foaming of the product in the respective bottle 2 before closing in order to evacuate air present in the head space 2.3. Even with such a method, the invention offers considerable advantages because uncontrolled foam formation during filling is avoided and thus a controlled pressurization of the product with a foam-forming energy input for controlled and reproducible foam formation before the closing of the bottle 2 in question is possible.

Above, the invention has been described by means of an embodiment. It is understood that changes and modifications are possible without leaving the concept on which the invention is based. For example, it was already mentioned above that the energy input, e.g. the input of ultrasonic energy or energy in some other form, may also be used in a favorable manner for suppressing or reducing the foam formation, not only in the filling system 1 for pressure filling but also in other filling systems, for example for filling bottles 2 or other containers under normal pressure, or for free jet filling.

Furthermore, it was assumed in the above that each filling element 5 of the filling system 1 or the filling machine is provided with an independent generator that generates the energy input, for example, in the shape of the ultrasonic wave generator 22. Principally, it is also possible to provide a common generator for energy input for all filling elements 5 of the filling machine or for a respective group of a plurality of filling elements 5 in order to suppress or reduce the foam formation. This generator will then be constantly connected via corresponding connections to a discharge element provided at the respective filling position 4 for outputting the energy, e.g. the ultrasonic wave, or via a coupling site with only the respective discharge elements of those filling positions 4 that during the rotary movement of the rotor 3 are positioned in an angular area of the rotary movement associated with the killing or relief phase or optionally with a preceding filling phase.

Moreover, it was assumed in the above that the methods suggested for treating or influencing the foam or the foam formation are to be regarded as alternative solutions. In the frame of the present invention, however, it is also proposed to use at least two of the suggested methods complementarily to each other. Here, the complementary use may be made simultaneously or with a time delay. For example, the foam formation can be prevented particularly effectively by the combination of a use of ultrasonic and laser beam because these methods and their effects do not affect each other but exclusively complement each other positively.

The invention claimed is:

1. A method for filling containers with a liquid product at a filling position, said method comprising: using a filling element for the controlled delivery of the product into the container, and at least one of reducing and/or suppressing foam formation in the product inside the container during a foam-formation stage by a treatment or by influencing the product and/or the foam, wherein reducing and/or suppressing foam formation comprises directing ultrasonic energy through a return gas tube that is open at both ends thereof into a headspace above a surface of liquid product in the container.

2. The method of claim 1, wherein reducing and/or suppressing foam formation is carried out in a container located at the filling position.

3. The method of claim 1, wherein reducing and/or suppressing foam formation is carried out while filling the container.

4. The method of claim 1, further comprising, after reducing and/or suppressing foam formation, causing controlled foaming of the product.

5. The method of claim 4, wherein causing controlled foaming comprises introducing energy into the product.

6. The method of claim 1, wherein reducing and/or suppressing foam formation is carried out after filling the container.

7. The method of claim 1, wherein reducing and/or suppressing foam formation is carried out during a relief phase subsequent to filling the container.

8. The method of claim 1, wherein the ultrasonic energy is directed to the product level in the container.

9. The method of claim 1, wherein reducing and/or suppressing foam formation comprising introducing a gaseous pressure medium into the product or foam.

10. An apparatus for filling containers with a liquid product, said apparatus comprising a filling machine having a filling position, a filling element at said filling position for the controlled delivery of the product into a container, a return gas pipe having a first end and a second end, the second end opening into a headspace of the container, and an influence-generating element, at said filling position for generating an influence on the liquid product inside the container, said influence causing a reduction and/or suppression of foam formation in the liquid product inside the container, wherein the influence-generating element comprises an ultrasonic generator disposed to direct ultrasonic energy into the first end of the gas pipe for propagation into the headspace.

11. The apparatus of claim 10, wherein the influence-generating element is configured to be within an area of the product level inside the container.

12. The apparatus of claim 10, wherein the influence-generating element is configured to be inside the container.

13. The apparatus of claim 10, wherein said filling machine includes a plurality of filling positions, each having a filling element, and wherein each filling element comprises a gas pipe having a first end and a second end, and an energy source for generating an energy input, said energy source being provided independently of each filling position, wherein said energy source comprises an ultrasonic generator disposed to direct ultrasonic energy into said first end of a gas pipe for propagation into a headspace into which said second end opens.

14. The apparatus of claim 10, further comprising: means for controlling the element such that energy from said an influence-generating element is provided while filling the container.

15. The apparatus of claim 10, wherein said filling machine includes a plurality of filling positions, each having a filling element, and wherein said apparatus comprises an energy source that provides energy jointly for all filling positions.

16. The apparatus of claim 10, wherein said filling machine includes a plurality of filling positions, each having a filling element, and wherein said apparatus comprises an energy source that provides energy jointly for a group of said filling positions within said plurality of filling positions.

17. The apparatus of claim 10, further comprising means for controlling the element such that the treatment is carried out after filling the container.

18. The apparatus of claim 10, further comprising means for controlling the element such that the treatment is carried out until a filled container is lifted from the filling position.

* * * * *